US006297435B1

(12) United States Patent
Gutowski

(10) Patent No.: US 6,297,435 B1
(45) Date of Patent: Oct. 2, 2001

(54) METHOD AND APPARATUS FOR MANUALLY MODULATING WAVELENGTH AND MANIPULATING SOUND FOR STRINGED INSTRUMENTS

(76) Inventor: Stephan Smith Gutowski, 261 E. 10th St., #3, New York, NY (US) 10009

( * ) Notice: Subject to any disclaimer, the term of this patent is extended or adjusted under 35 U.S.C. 154(b) by 0 days.

(21) Appl. No.: 09/414,851

(22) Filed: Oct. 12, 1999

(51) Int. Cl.[7] ..... G10D 3/00
(52) U.S. Cl. ..... 84/315; 84/319; 84/307
(58) Field of Search ..... 84/315, 316, 317, 84/319, 298, 307

(56) References Cited

U.S. PATENT DOCUMENTS

| | | | | |
|---|---|---|---|---|
| 1,649,376 | * | 11/1927 | Bacon et al. | 84/308 |
| 2,184,733 | * | 12/1939 | Burgien | 84/319 |
| 2,248,542 | * | 7/1941 | McDaniel et al. | 84/319 |
| 2,493,698 | * | 1/1950 | Schwartz | 84/319 |

* cited by examiner

*Primary Examiner*—Shih-Yung Hsieh
(74) *Attorney, Agent, or Firm*—Boris Haskell

(57) ABSTRACT

A stringed musical instrument having a bridge and a slide, such as a guitar, wherein the slide is carried by a finger on the strumming or picking hand of the musician, for contact with and movement along the strings in an area adjacent to the bridge.

5 Claims, 2 Drawing Sheets

FIG. 3
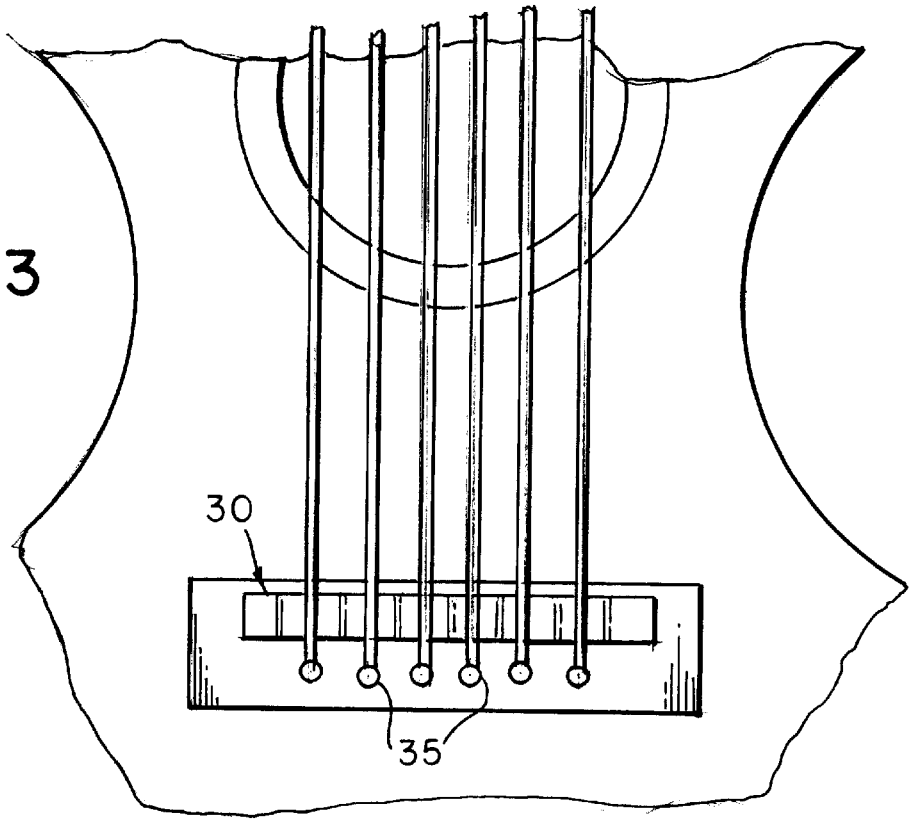
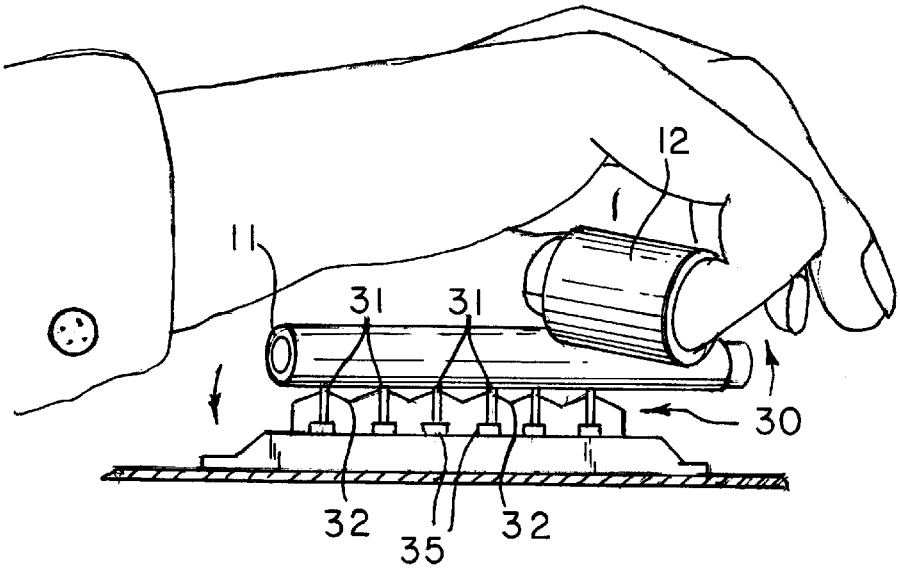
FIG. 4

METHOD AND APPARATUS FOR MANUALLY MODULATING WAVELENGTH AND MANIPULATING SOUND FOR STRINGED INSTRUMENTS

CROSS-REFERENCES TO RELATED APPLICATIONS (Not Applicable).

STATEMENT REGARDING FEDERALLY SPONSORED RESEARCH OR DEVELOPMENT (Not Applicable).

BACKGROUND OF THE INVENTION

1. Field of the Invention

The present invention relates to the modulation of tone and wavelength, and producing other effects, manually, on either acoustic or electric stringed instruments, particularly on guitars, by the use of a manual "slide" or "steel".

2. Description of the Related Art (Not Applicable).

BRIEF SUMMARY OF THE INVENTION

Whereas manual slides are commonly used on guitars, they are used in conjunction with the fingering hand of the player on the finger board or neck of the guitar, to contact the strings in appropriate locations for selecting the notes to be played. In accordance with the present invention, however, the manual slide is used on the strumming or picking hand of the guitar player, and it is positioned adjacent and in front of the bridge of the guitar. This enables the player to introduce a vibrato or tremolo, or otherwise to affect the voice and texture and wave properties of the notes being played, or to introduce other effects. These effects are facilitated by the fact that the slide is manipulated by the strumming hand, independently of the fingering action and note selection, and movement or oscillation of the slide over the strings toward and away from the bridge, has a direct effect on the length of the string(s) subject to strumming or picking vibration. The present invention enables one to obtain in an entirely manual instrument, many of the effects that have heretofore been limited to auxiliary mechanical and electrical devices, giving the musician much greater expressive control of the music being produced.

Since in the practice of the present invention the slide is associated with the picking or strumming hand, the fingering hand can function without restriction, allowing it to perform all manipulations previously made in normal guitar playing. Furthermore, since the slide is positioned to hover directly above or in close proximity to the bridge, subtle effects resulting from the controlled contact of the slide with the strings, such as buzz, vibration, and wavelength modulation, which would be inaudible or too quiet to be of any value if created by use of a slide elsewhere on the instrument, become audible and controllable, because of the immediate proximity to the bridge.

Also, because the slide is being used adjacent to the bridge of the stringed instrument, it is desirable that the bridge be designed to accommodate the use of the slide. First, it is most desirable that the bridge support the strings in a straight line, or lying in a flat plane, particularly in the direction transverse to the length dimension of the strings, or across the guitar, so that the slide can contact all strings simultaneously. Second, it is important that the slide not contact the bridge per se, to avoid any such contact sounds. To this end, it is desirable that each string rest on the top of an individual bridge pinnacle, with the bridge recessed into valleys between pinnacles. Further, it is desirable that any portions of the bridge extending beyond the first and last strings be cut back below the level of the strings.

It is accordingly one object of the present invention to provide musical effects in a stringed instrument, by use of a manual slide adjacent to the bridge of the instrument.

Another object of the present invention is to provide musical effects in a guitar, by use of a manual slide adjacent to the bridge.

A further object of the present invention is to provide musical effects in a stringed instrument, such as a guitar, by use of a manual slide adjacent to the bridge of the instrument, wherein the bridge is designed to accommodate the slide and to avoid contact between the slide and the bridge.

Other objects and advantages of the present invention will become apparent to those skilled in the art from a consideration of the following detailed description of the invention, had in conjunction with the accompanying drawings, in which like numerals refer to like or corresponding parts, and wherein:

BRIEF DESCRIPTION OF THE SEVERAL VIEWS OF THE DRAWINGS

FIG. 3 is a top plan view of a portion of the soundbox of a manual guitar, showing a top view of the bridge;

FIG. 4 is an elevational view of the bridge, showing its pinnacles and valleys and the strings lying on the pinnacles.

DETAILED DESCRIPTION OF THE INVENTION

Figure 1:
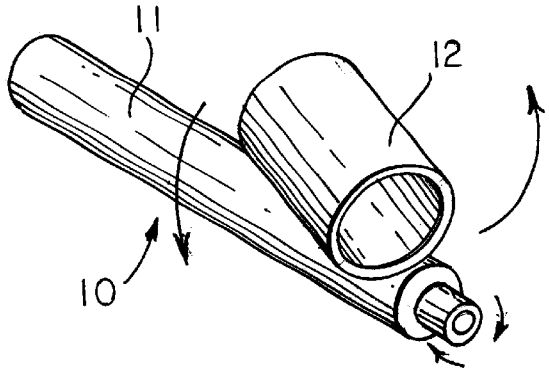
FIG. 1 is an isometric view of the slide in accordance with the present invention.
Figure 2:
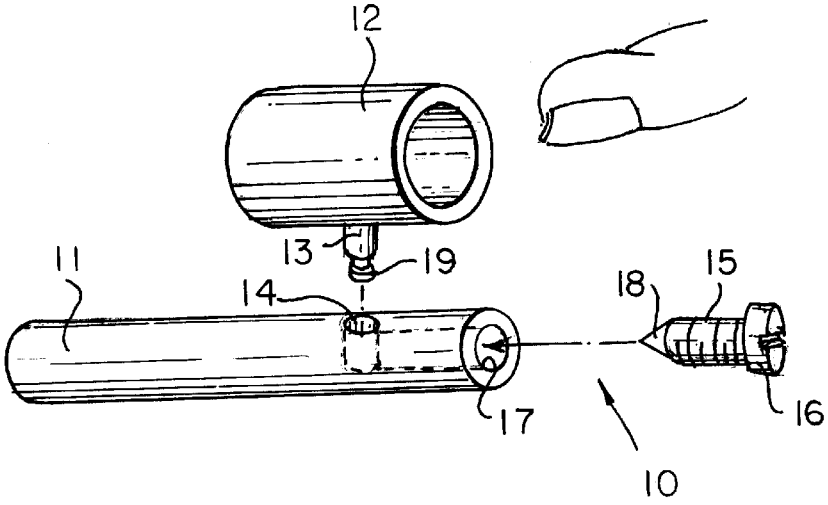
FIG. 2 is an exploded view of the slide shown in FIG. 1.

Referring to FIGS. 1 and 2, the slide 10 contains two primary parts, the rod 11 and finger ring 12. The rod is preferably made of steel or brass for the best tone effects. The ring 12 is assembled to the rod 11 by means of a post 13 attached to the ring, and the post fits into the diametric hole 14 in the rod. A retaining screw 15 with a knurled head 16 is threaded into the threaded axial hole or receptacle 17 in the rod. When the ring post 13 is inserted into hole 14 and the retaining screw 15 is fully threaded into its threaded receptacle 17, its conical end 18 enters the circumferential groove 19 near the end of post 13, thus retaining the ring and post mounted on the rod 11. However, while the screw 15 is designed to retain the ring 12 and post 13 assembled to the rod 11, it does not necessarily clamp the ring post, leaving the ring 12 free to swivel about the axis of the hole 14, while being retained in assembled relation with the rod 11. Obviously, the screw 15 can clamp the ring 12 and post 13 in a fixed position relative to rod 11, if desired.

In use, the musician inserts the little finger of his or her strumming hand into the ring, as indicated in FIGS. 2 and 4. In this way, the playing fingers are positioned and are free to pick or strum the strings, while the slide 10 is positioned and moved along the strings adjacent the bridge, as desired by the musician, and as indicated in FIG. 4.

Figure 5:
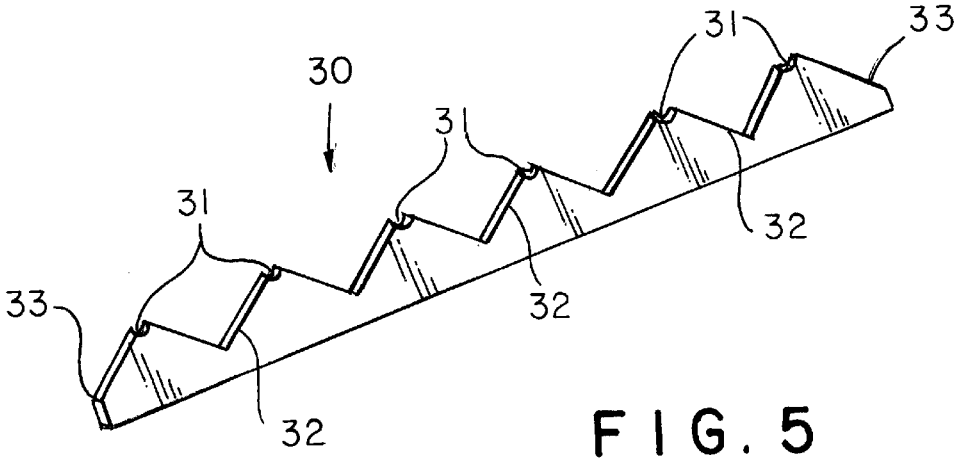
FIG. 5 is an enlarged isometric view of the bridge.

Turning next to the bridge 30, it is illustrated in FIGS. 3, 4 and 5. The preferred form of bridge 30 comprises a series of notched pinnacles 31 (shown as six, to receive six guitar strings), separated by a series of intervening valleys 32. The pinnacles are arranged to lie in a straight line, so that the musical strings, when placed in the notches and drawn taught over the bridge, all lie in a flat plane adjacent the bridge in the area toward the fingering or fret board of the guitar. Thus, the slide rod 11 is able to contact all the strings simultaneously, as shown in FIG. 4. In addition, the ends of the bridge beyond the strings on each side, are also recessed, as shown at 33. This structure permits the slide to remain in contact with the strings adjacent to the bridge at all times, without suffering contact with the bridge. Were the latter to occur, the contact noise would have a disturbing effect on the musical sound. Similarly, a leather, felt or other cover may be placed over the string anchorages 35 behind the bridge, when closely adjacent to the bridge 30.

Thus, as illustrated in FIGS. 2 and 4, the musician mounts the slide on the strumming or picking hand by inserting the little finger into the ring 12, leaving the playing fingers in position and free to strum or pick in the usual manner. While the musician strums or picks the strings of the guitar, the slide is placed across the strings adjacent to the bridge and the slide is oscillated lengthwise along the strings to create a vibrato or tremolo effect, or other analogous variation in the tonal quality, as desired by the musician.

As is apparent from the foregoing description, different size rings 12 many be mounted on a given rod 11, as required or desired. And if desired, the ring 12 may be lined with leather, fabric or a cushioning material. Likewise, a given size ring 12 may be mounted on various rods, either of different size, different material, or different structure.

Other modifications and variations of the invention will be perceived, and such as are embraced by the spirit and scope of the appended claims are contemplated as being within the purview of the present invention.

What is claimed is:

1. A combination of a stringed musical instrument having a bridge, and a slide; said bridge having a set of pinnacles having tops and interposed valleys between the pinnacles, the tops of said pinnacles being located in a straight line and receiving the strings of the instrument thereon to place the strings in a flat plane in the area adjacent to one side of the bridge when the strings are drawn taut over the bridge; said slide having a bar for contacting said strings, and having a ring assembled to said bar for receiving the finger of a user, for positioning the bar on said strings in said area adjacent to said bridge, and for moving the bar along said strings adjacent said bridge, as desired, wherein said bar has a transverse hole therein, said ring has a post pivotally received in said hole, said post has a circumferential groove, said bar has a threaded hole transverse to said post, and a retainer threaded into said threaded hole and engaging said circumferential groove to retain said ring assembled to said bar.

2. The combination as set forth in claim 1, wherein said musical instrument is a guitar.

3. The combination as set forth in claim 1, wherein the tops of said pinnacles are notched to receive the strings.

4. A method of playing a stringed musical instrument having a bridge, wherein said bridge has a set of pinnacles having tops and interposed valleys between adjacent pinnacles, the tops of said pinnacles being located in a straight line and receiving the strings of the instrument thereon to place the strings in a flat plane in the area adjacent to one side of the bridge when the strings are drawn taut over the bridge, comprising the steps of manually locating a slide bar in contact with said strings in said area adjacent to said bridge, and manually moving said slide bar toward and away from said bridge in said area while manually plucking or strumming the strings to introduce a vibrato or tremolo or type texture into the music.

5. The method as set forth in claim 4, wherein said slide bar carries a ring, and said ring is mounted on a finger of the plucking or strumming hand.

* * * * *